United States Patent [19]

Granot et al.

[11] Patent Number: 4,635,917

[45] Date of Patent: Jan. 13, 1987

[54] METHOD AND APPARATUS FOR FEEDING SHEETS, PARTICULARLY FABRICS FROM A STACK

[75] Inventors: Daniel Granot; Ahron Siev; Freddy Derfler, all of Haifa, Israel

[73] Assignee: State of Israel, Ministry of Defense, Rafael Armament, Haifa, Israel

[21] Appl. No.: 678,585

[22] Filed: Dec. 5, 1984

[30] Foreign Application Priority Data

Mar. 2, 1984 [IL] Israel ..... 71133

[51] Int. Cl.[4] ..... B65H 3/22; B65H 3/14

[52] U.S. Cl. ..... 271/9; 271/97; 271/18.3; 271/104; 271/169; 271/227

[58] Field of Search ..... 271/9, 90, 97, 18.3, 271/100, 101, 102, 105, 106, 104, 22, 24, 48, 118, 157, 160, 162, 168, 169, 147, 19, 20, 21, 23, 25; 221/227

[56] References Cited

U.S. PATENT DOCUMENTS

| | | | |
|---|---|---|---|
| 1,365,383 | 1/1921 | Cooper | 271/168 |
| 3,168,308 | 2/1965 | Walton et al. | 271/106 |
| 3,314,676 | 4/1967 | Fromm | 271/106 |
| 4,116,428 | 9/1978 | Schubert | 271/106 |
| 4,160,545 | 7/1979 | Spence-Bate | 271/106 |
| 4,283,047 | 8/1981 | Blessing | 271/18.3 |

FOREIGN PATENT DOCUMENTS

| | | | |
|---|---|---|---|
| 0039258 | 3/1977 | Japan | 271/20 |
| 2028281 | 3/1980 | United Kingdom . | |

*Primary Examiner*—Duane A. Reger
*Assistant Examiner*—James E. Barlow
*Attorney, Agent, or Firm*—Benjamin J. Barish

[57] ABSTRACT

A method and apparatus for feeding sheets, particularly fabrics, from a stack comprises an arrangement for: engaging the opposite edges of the upper sheet of the stack by a pair of restrainer members, bringing a pick-up head into engagement with the upper sheet of the stack while producing air streams from the pick-up head directed outwardly across the opposite edges of the upper sheet of the stack, lowering the pick-up head to depress the stack below the restrainer members whereby the air streams cause the opposite edges of the upper sheet of the stack to curl upwardly to clear the restrainer members, lifting the upper sheet from the stack, and permitting the stack to rise so as to bring the next sheet into engagement with the restrainer members.

17 Claims, 9 Drawing Figures

METHOD AND APPARATUS FOR FEEDING SHEETS, PARTICULARLY FABRICS FROM A STACK

BACKGROUND OF THE INVENTION

The present invention relates to a method and apparatus for feeding sheets from a stack. The invention is particularly useful for feeding sheets of fabric from a stack or pile, and is therefore described below with respect to this application.

The feeding of paper, cardboard and similar sheets is relatively simple, and many such feeding devices have been developed and are in widespread use. The feeding of fabrics and similar types of limp and/or porous materials is considerably more difficult because of the limpness and porosity of such materials, in addition to their softness, roughness, compressibility, surface friction or adhesion, and the like. The foregoing properties of such materials introduce many problems which are difficult to overcome in an automatic handling system. Thus, the limpness and softness of these materials cause contacting surfaces to intermesh, making them difficult to separate; their limpness also makes lifting difficult; their roughness causes the underlying sheet to be carried with the upper sheet when moved transversely of the stack or pile; the threads at the edges of the adjacent sheets often are entangled and not aligned. Vacuum devices for lifting such sheets are usually not effective because of the porosity of the sheets. Adhesives have also so far been found ineffective, and are usually not desired because of the possibility of marking or damaging the sheets. A number of air-jet devices have been designed for this purpose, in which the air-jets produce a lift or flutter of the topmost sheet for separating it. Examples of the latter type devices are illustrated in U.S.A. Pat. Nos. 3,877,695, 3,796,455, 3,738,645, 3,647,202, 3,596,900, 3,539,177, 3,168,308 and 3,168,307; but even these air-type devices have still not been found entirely satisfactory.

SUMMARY OF THE INVENTION

An object of the present invention is to provide a method and also apparatus for feeding sheets from a stack, which method and apparatus are particularly useful with respect to fabrics or other sheets having similar characteristics as discussed above.

According to one broad aspect of the present invention, there is provided a method for separating sheets from a stack, comprising the steps:

(a) engaging the opposite edges of the upper sheet of the stack by a pair of restrainer members overlying the opposite edges;

(b) bringing a pick-up head into engagement with the upper sheet of the stack between the restrainer members while producing air streams from the pick-up head directed outwardly across the opposite edges of the upper sheet of the stack;

(c) effecting relative displacement between the stack and the restrainer members in one direction such that the stack is spaced below the restrainer members and the air streams cause the opposite edges of the upper sheet of the stack to curl upwardly to clear the restrainer members;

(d) lifting the upper sheet from the stack;

(e) and effecting relative displacement between the stack and the restrainer members in the opposite direction from step (c) such that the opposite edges of the next underlying sheet of the stack are brought into engagement with said remembers.

In the described preferred embodiment, step (d) is effected by maintaining the air streams to cause the upper sheet to adhere to the pick-up head which pick-up head removes the upper sheet from the stack.

According to a further feature in the described preferred embodiment, during step (d), lateral movement of the upper sheet is prevented by pins carried by the pick-up head penetrating the upper sheet.

According to a still further feature in the described preferred embodiment, the air streams produced during steps (d) are of a lower velocity than the air streams produced during step (b).

The invention also provides sheet feeding apparatus operated in accordance with the foregoing method.

Further features and advantages of the invention will be from the description below.

BRIEF DESCRIPTION OF THE DRAWINGS

The invention is herein described, by way of example only, with reference to the accompanying drawings wherein.

DESCRIPTION OF A PREFERRED EMBODIMENT

Figure 1:
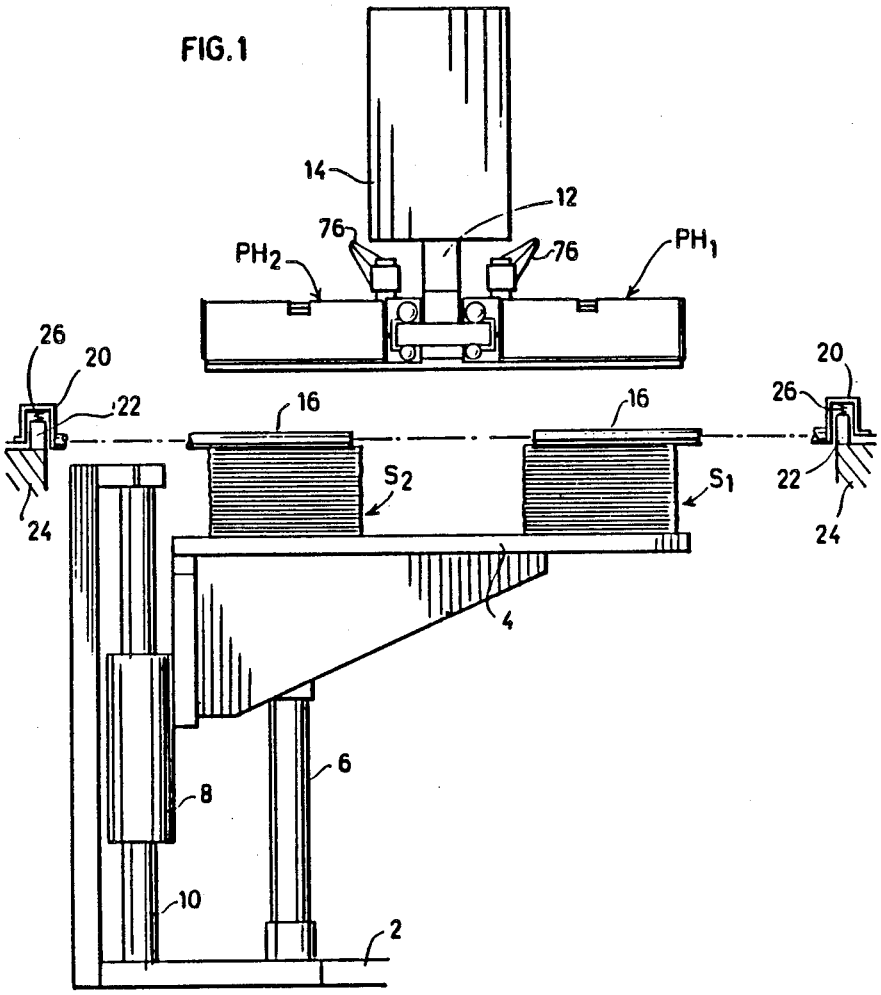
FIG. 1 is an end view illustrating one form of apparatus constructed in accordance with the present invention.

The apparatus illustrated in the drawings is particularly useful for separating and feeding sheets of fabric or similar materials from a stack or pile; actually, the illustrated apparatus acts on two stacks $S_1$, $S_2$ simultaneously. Briefly, the apparatus comprises a base 2 supporting a horizontal table 4 adapted to receive the two stacks $S_1$, $S_2$ of the sheet materials. Table 4 is mounted for vertical movement by means of a piston-cylinder drive 6 and is guided during its vertical movement by a sleeve 8, slideably received around a vertical post 10 supported by the base 2. The apparatus further includes a pair of pick-up heads $PH_1$, $PH_2$, supported on a common mounting member 12 having an attachment fixture, shown schematically at 14, for attaching same to a robot arm or the like (not shown) which feeds the sheets individually from the stack $S_1$, $S_2$ to the desired locations for further processing, handling, storage or the like. Many different types of attachment fixtures and robot arms or other transfer devices are known which can be used.

The apparatus further includes a pair of elongated, parallel restrainer members in the form of rods 16, 18 located to overlie the two stacks, $S_1$, $S_2$ and to engage the opposite edges of the top sheet in each stack. As shown in FIG. 1, each of the opposite ends of restrainer rod 16 includes a U-shaped member 20 received over a bar 22 carried by a fixed support 24 to permit adjustment of the restraining rod (in the direction in and out of the plane of the drawing of FIG. 1, or left to right in FIG. 2). A spring 26 interposed between bar 22 and member 20 releasably retains rod 16 in its adjusted position. A similar arrangement (not shown) is provided to permit adjustment of restraining rod 18.

Figure 2:
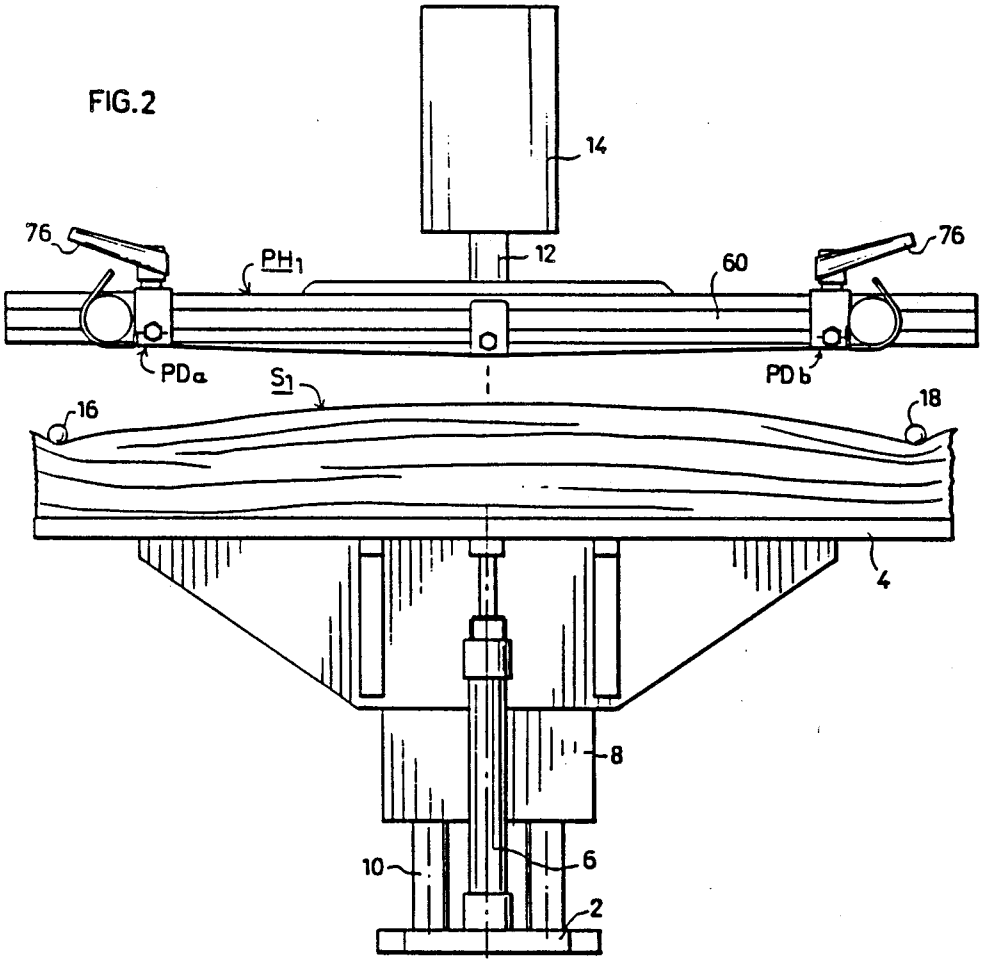
FIG. 2 is a side elevational view of the apparatus of FIG. 1.

Each of the two pick-up heads $PH_1$, $PH_2$ includes two pick-up devices $PD_a$, $PD_b$ each overlying one of the two opposite edges of the upper sheet in the respective stack. FIG. 2 illustrates the two pick-up devices $PD_a$, $PD_b$ for head $PH_1$ FIGS. 3–5 more particularly illustrate the construction of pick-up device $PD_a$; pick-up device $PD_b$ for head $PH_1$, and the two pick-up devices for the other pick-up head $PH_2$, are of the same construction.

Figure 3:
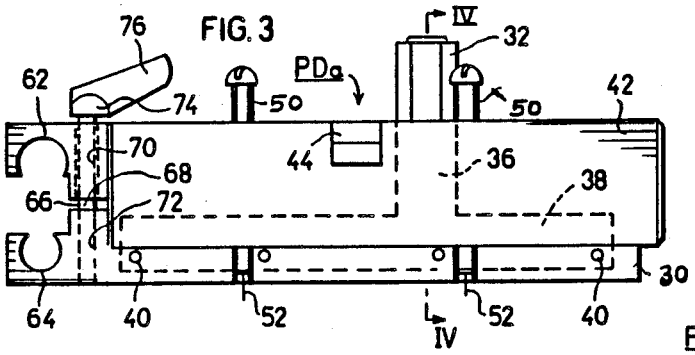
FIG. 3 is an end view of one of the pick-up heads in the apparatus of FIGS. 1 and 2.
Figure 4:
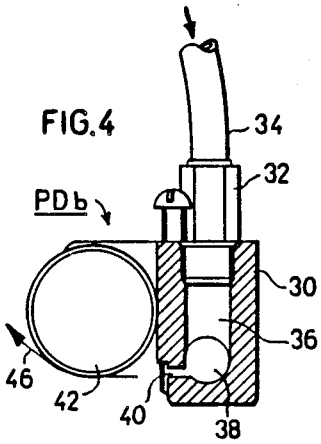
FIG. 4 is a section along lines IV—IV of FIG. 3.
Figure 5:
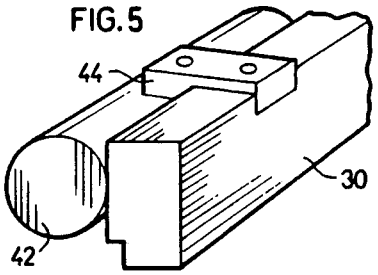
FIG. 5 is a fragmentary three-dimensional view of a portion of the pick-up head of FIGS. 3 and 4; and FIGS. *6a–6b* illustrate different stages during the operation of the apparatus.

As shown particularly in FIGS. 3 and 4, pick-up device $PD_a$ includes a housing 30 having a connector 32 for connection to a tube 34 leading to a supply of pressurized air (not shown). The air is introduced through a bore 36 formed in the housing leading to an internal chamber 38 extending substantially the complete length of the housing. The housing is further formed with a plurality of openings 40 spaced along the length of chamber 38 for producing a plurality of air streams or jets substantially at a right angle to the outer face of the housing and spaced along its length.

A cylindrical member 42 is mounted to the front face of housing 30 by means of a bracket 44, such that the lower end of the cylindrical member 42 is substantially aligned with the axes of the air outlet openings 40. Thus, the air streams or jets are outletted from the latter openings substantially tangentially to the lower face of cylindrical member 42. Since this lower face curves upwardly, the air stream follows this curvature and thereby produces a lifting force curling the respective edge of the upper sheet of the stack upwardly. This is used for separating the upper sheet from its stack, as will be described more particularly below with reference to the operation of the apparatus as illustrated in FIGS. *6a–6d*.

Housing 30 of each pick-up device further includes a pair of vertical bores each receiving a threaded bolt 50 each carrying at its lower end a pin 52, 54 to project below the lower surface of the housing, as shown particularly in FIG. 3. The pins 52, 54 are adapted to penetrate the upper sheet during its separation from the stack. Pins 52, 54 may be of very small diameter since their purpose is not to pick up the upper sheet of the stack, but rather merely to prevent the lateral displacement of the upper sheet when it is picked up and transferred by air pressure, as will be described below.

The two pick-up devices $PD_a$, $PD_b$ for pick-up head $PH_1$ are mounted on a common horizontal bar 60 and include means for adjusting the pick-up device along the length of the mounting bar to accommodate different size sheets with respect to which the apparatus may be used. For this purpose, the end of housing 30 of each pick-up device is bifurcated to define two clamping jaws 62,64 (FIG. 3) separated by a slot 66A screw 68 is received within a bore formed in clamping jaw 62. The upper end of the bore is enlarged, and the lower end is threaded for receiving the lower threaded end 72 of this pin. Pin 68 includes an enlarged head 74 bearing against the outer face of clamping jaw 62. Head 74 of the pin is fixed to a lever arm 76.

It will thus be seen that when lever arm 76 is manually turned in one direction, pin 68 permits the two clamping jaws 62, 64 to spread apart so that the pick-up device may be adjusted along the length of the mounting arm 60; and when the arm is turned in the opposite direction, the two clamping jaws are drawn together to fix the pick-up device in position on the mounting arm.

The apparatus illustrated in the drawings operates in the following manner:

First, the horizontal table 4 is loaded with the two stacks or piles $S_1$, $S_2$ of sheet materials, such as fabrics or the like, to be handled. The two restraining rods 16, 18 are adjusted along bars 22 so that they are slightly inwardly spaced from and overlie the two opposite edges of the stacks $S_1$, $S_2$. The pick-up devices ($PD_a$, $PD_b$) of each of the two pick-up heads $PH_1$, $PH_2$ are then adjusted along their mounting bar 60, by turning lever arm 76 in one direction to permit the adjustment, and then in the opposite direction, to fix the devices in proper position spaced slightly inwardly of the restraining rods 16,18 for the two stacks.

After these preliminary adjustments have been made for the respective materials to be handled, the apparatus is operated according to the following sequence of steps:

(a) Table 4 carrying the two stacks $S_1$, $S_2$ is driven upwardly by the piston-cylinder drive 6, so as to cause the opposite edges of the upper sheet of each stack to be engaged by the lower faces of the two restraining rods 16, 18 (FIG. *6a*);

(b) The two heads $PH_1$, $PH_2$ are driven downwardly to bring their pick-up devices into engagement with the upper sheet of each stack between the restraining rods 16, 18, while pressurized air is applied via tubes 34 to the pick-up devices of the two heads, to produce air streams or jets outletted from the openings 40 tangentially to the lower faces of cylinders 42. The heads are then further driven downwardly to displace the stack downwardly so as to move the stacks below, and out of contact with, the restraining rods 16, 18 (FIG. *6b*); this lowering of the stacks is permitted by the air cushion formed by the piston-cylinder drives 6, which air cushion acts as a spring as schematically shown in FIGS. *6a–6d;*

(c) After the stack has been lowered below the restraining rods 16, 18, the air flow causes the opposite ends of the upper sheet of each stack to curl upwardly, to clear the restraining rods 16, 18 (FIG. *6c*). At this time, the pins 52, 54 carried at the lower end of the pick-up devices have penetrated the upper sheet (and perhaps one or more of the lower sheets) of the respective stacks.

(d) The air flow is maintained through the outlet openings 40, as the pick-up heads are moved upwardly so as to remove the upper sheet of the respective stack, this being permitted because the opposite ends had been curved upwardly to clear restraining rods 16, 18, as described in the preceding step. With this disengagement of the pick-up heads from the stack, the underlying remainder of the stacks is permitted to rise with table 4 by the air cushion formed by the piston-cylinder drive 6, whereupon the new upper sheet of each stack is now engaged by the two restraining rods 16, 18, ready for a new cycle of operation of the apparatus.

The curling upwardly of the opposite edges of the upper sheet to clear the restraining rods 16, 18 (FIG. *6c*) usually requires a greater velocity of air than that required to hold the upper sheet from the remainder of the stack (FIG. *6d*). Accordingly, the air velocity applied to the pick-up devices may be higher for step FIG. *6c*, (e.g. 4 atmospheres) and may then be lowered (e.g. 2 atmospheres) for the step illustrated in FIG. *6d*.

Figure 6A:
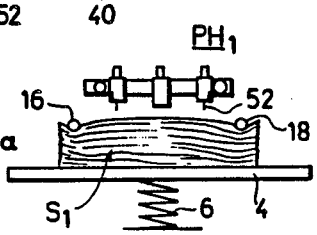
Figure 6B:
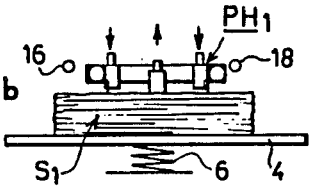
Figure 6C:
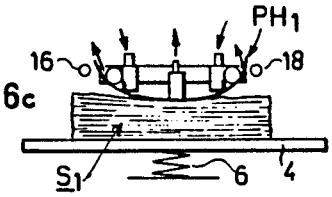
Figure 6D:
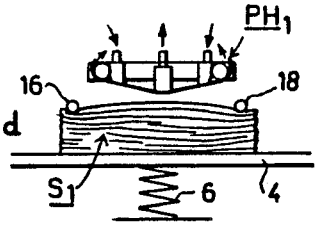

As indicated earlier, pins 52, 54 may be made of very small diameter since their purpose is not to pick-off the upper sheet of the stack, but rather merely to prevent lateral movement of the upper sheet when picked-off by the air flow in the step illustrated in FIG. 6*d*. This is because the air flow applied to the opposite edges of the upper sheet is in opposite directions but not always equal, and therefore, there may be a tendency for the sheet to move laterally of its pick-up device during the transfer of the sheet. Such lateral movement is prevented by pins 52, 54.

The piston-cylinder drive 6, would be continously or periodically adjusted to maintain a constant level between the upper sheets of the stacks with respect to the fixed restraining rods 16, 18. This drive, as indicated earlier, also serves as a cushion or yieldable means urging the table, and the stacks thereon, towards the restraining rods 16, 18 when the respective pick-up head is out of contact with its stack, as shown in FIGS. 6*a* and 6*d*.

It will be appreciated that the apparatus can include various combinations, sizes and locations of these pick-up heads according to the size shape, weight, etc. of the sheets being handled. The illustrated embodiment is therefore to be regarded as for purposes of example only, since many other variations, modifications and applications of the invention may be made.

What is claimed is:

1. A method of feeding sheets from a stack comprising the steps:

(a) engaging the opposite edges of the upper sheet of the stack by a pair of restrainer members overlying said opposite edges;

(b) bringing a pick-up head into engagement with the upper sheet of the stack between said restrainer members while producing air streams from said pick-up head directed outwardly across the opposite edges of the upper sheet of the stack;

(c) effecting relative displacement between said stack and said restrainer members in one direction such that the stack is spaced below said restrainer members and said air streams cause the opposite edges of the upper sheet of the stack to curl upwardly to clear said restrainer members;

(d) lifting said upper sheet from the stack;

(e) and effecting relative displacement between said stack and said restrainer members in the opposite direction from step (c) such that the opposite edges of the next underlying sheet of the stack are brought into engagement with said restrainer members.

2. The method according to claim 1, wherein step (c) is effected by lowering said pick-up head to cause same to depress said stack below said restrainer members; and step (e) is effected to permitting said stack to rise so as to bring the next sheet into engagement with said restrainer members.

3. The method according to claim 1, wherein step (d) is effected by maintaining said air streams to cause said upper sheet to adhere to the pick-up head which pick-up head removes said upper sheet from the stack.

4. 4. The method according to claim 3, wherein during step (d), lateral movement of said upper sheet is prevented by pins carried by the pick-up head penetrating said upper sheet.

5. The method according to either of claims 3 or 4, wherein said air streams produced during step (d) are of a lower velocity than the air streams produced during step (b).

6. Sheet-feeding apparatus, comprising a horizontal table for supporting a plurality of sheets in a stack, and a pick-up head overlying said table and having air openings for producing air streams outwardly across opposite edges of the upper sheet of the stack to curl upwardly such edges and thereby to separate them from the remainder of the stack, characterized in that said apparatus further comprises: a pair of restrainer members overlying and engageable with said opposite edges of the stack; the air streams produced by said pick-up head being effective to curl upwardly said opposite edge of the upper sheet of the stack; and displacing means effecting relative displacement between said stack and said restrainer members in one direction such that the complete stack is displaced below said restrainer members and after the opposite edges of said upper sheet have been curled upwardly to clear said restrainer members, effecting relative displacement between said stack and said restrainer members in the opposite direction such that the opposite edges of the next underlying sheet of the stack are brought into engagement with the restrainer members.

7. Apparatus according to claim 6, wherein: said apparatus includes yielding means urging said table toward said restrainer members to bring the opposite edges of the upper sheet of the stack into engagement with the lower faces of the restrainer members; and said displacement means lowers said pick-up head into engagement with said stack and depresses said stack against said yielding means in order to lower said stack to cause the opposite edges of the upper sheet to curl upwardly and to clear said restrainer members.

8. Apparatus according to claim 6, wherein said restrainer members are in the form of elongated rods.

9. Apparatus according to claim 7, wherein said yielding means comprises an air cushion produced by a piston movable within a cylinder.

10. Apparatus according to claim 6, wherein said pick-up head removes said upper sheet from the stack by maintaining said air streams to cause the sheet to adhere to the pick-up head.

11. Apparatus according to claim 10, wherein said pick-up head includes a pin adapted to penetrate said upper sheet and thereby to prevent its movement laterally of the pick-up head when removing same from the stack.

12. Sheet feeding apparatus comprising a horizontal table for supporting a plurality of sheets in a stack, and a pick-up head overlying said table and having air openings for producing air streams along the opposite edges of the upper sheet of the stack to curl upwardly said edges of the upper sheet and thereby to separate the upper sheet from the remainder of the stack; characterized in that said pick-up head includes: a pair of restrainer members overlying the opposite edges of the upper sheet of the stack yielding means urging the table towards said restrainer members to bring the opposite edges of the upper sheet of the stack into engagement with the lower faces of the restrainer members; the air streams produced by said pick-up head being effective to curl upwardly said opposite edges of the upper sheet of the stack so as to clear them from the restrainer members; displacing means for effecting relative displacement between said stack and said restrainer members in one direction, before the air streams curl upwardly the outer edges of the upper sheet of the stack, such that the stack and the upper sheet thereof are spaced below the restrainer members, and after said opposite edges of the upper sheet have been curled upwardly to clear the restrainer members, for effecting relative displacement between the stacks and the restrainer members in the opposite direction such that the opposite edges of the next underlying sheet of the stack is brought into engagement with the restrainer members; and a pin adapted to penetrate said upper sheet of the stack and thereby to prevent its movement laterally of the pick-up head when removing same from the stack.

13. Apparatus according to claim 12, wherein there are a plurality of pins each carried at the end of a threaded fastener passing through the pick-up head and threadedly adjustable therein to penetrate sheets of different thicknesses.

14. Apparatus according to claim 12, wherein said pick-up head produces said air streams of one velocity when curling upwardly the opposite edges of the upper sheet of the stack, and produces air streams of a lower velocity when separating the upper sheet from the stack.

15. Apparatus according to claim 12, wherein said pick-up head comprises a curved surface curving upwardly away from said table, said air openings being located to cause the air streams to flow tangentially to said curved surface.

16. Apparatus according to claim 12, wherein said pick-up head is adjustably attached to a horizontal supporting arm for adjusting the same for different size sheets.

17. Apparatus according to claim 12, wherein said table accommodates two stacks of sheets, and the apparatus includes two of said pick-up heads, one of each of said stacks.

* * * * *